United States Patent [19]

Delauder

[11] 4,442,937

[45] Apr. 17, 1984

[54] COVER FOR GOLF BAG

[76] Inventor: Roscoe E. Delauder, 8300 Harris Ave., Baltimore, Md. 21234

[21] Appl. No.: 428,137

[22] Filed: Sep. 29, 1982

[51] Int. Cl.[3] ..... A63D 55/00; B65D 85/00

[52] U.S. Cl. ..... 206/315.4

[58] Field of Search ..... 150/1.5 R, 1.5 B, 1.5 C; 206/315 R, 315.4; 220/252

[56] References Cited

U.S. PATENT DOCUMENTS

| | | | |
|---|---|---|---|
| 2,613,952 | 10/1952 | Lannon | 150/1.5 B |
| 2,768,668 | 10/1956 | Santosuosso | 150/1.5 B |
| 2,973,794 | 3/1961 | Erickson | 150/52 |
| 2,985,212 | 5/1961 | Dozier | 150/52 |
| 3,059,681 | 10/1962 | Larbeski | 150/52 |
| 3,913,648 | 10/1975 | Sessler | 150/1.5 R |

FOREIGN PATENT DOCUMENTS

| | | | |
|---|---|---|---|
| 756946 | 9/1956 | United Kingdom | 206/315.5 |

*Primary Examiner*—Joseph Man-Fu Moy

*Attorney, Agent, or Firm*—John F. McClellan, Sr.

[57] ABSTRACT

A clamp-on cover for the top of a golf bag provides a vertical hemi-cylindrical shield extending the back of the golf bag in upward direction but preserving a half-circular arc of access to clubs laterally, and a helmet-shaped portion pivoted at the brim to a rear portion of the hemi-cylindrical shield near but not at the top provides for the helmet-shaped portion to rise when opened to either a fully open stable position clear of the club head area or to the half open position at which it serves as a concave, high clearance, overhanging roof which is self-closing, while overlapping and co-acting with the vertical hemi-cylindrical portion to shield against blowing rain.

3 Claims, 5 Drawing Figures

COVER FOR GOLF BAG

FIELD OF THE INVENTION

This invention relates generally to sports equipment and particularly to a protective closure accessory for the open end of conventional golf bags.

PRIOR ART

In the prior art flexible covers with slide-fastener operation have been known, and pivotal and other covers associated with golf bags have been disclosed. The following U.S. patents indicate varieties of closure:

U.S. Pat. No. 3,913,648 issued to S. Sessler on 10-21-75 disclosed a flexible golf-bag-top cover with a flexible flap opening;

U.S. Pat. No. 3,059,681 issued to L. C. Lorbeski on 10-23-62 disclosed a wraparound type cover for the top of a golf bag which pivots on a pin 16, FIG. 4, and has weather flaps that can be secured together when not open;

U.S. Pat. No. 2,985,212 issued to R. H. Dozier on 5-23-61 disclosed an overall cover for a golf bag;

U.S. Pat. No. 2,973,794 issued to A. L. Erickson on 3-7-61 disclosed a top cover pivotal on an edge of the bag (see FIG. 3).

SUMMARY OF THE INVENTION

Regardless of the merits of the known art weather-cover equipment for closing over clubs in a golf bag, no such equipment has become the standard of the market for the purpose, and to provide such is a principal object of this invention.

Further objects are to provide a weather cover system which has no flexible flap to blow and flop around, which provides an upstanding weather half-shield for orientation to windward to keep out blowing rain while providing full top access and 180° side access to the clubs, with a complementary helmet closure overlapping the half shield in the down position and rising to form a high overhanging roof or downpour shield while still overlapping the upstanding weather half-shield at the windward side.

Yet further objects are to provide a system as described that is strongly protective of clubs and bag, which fastens securely and can be locked on any standard golf bag, which is quickly detachable and attachable, which has a handsome and uniquely distinctive appearance, and which is easy to operate, durable and reliable.

BRIEF DESCRIPTION OF THE DRAWINGS

The above and other objects and advantages of the invention will become more readily understood from the following description including the drawings, in which like characters refer to like parts.

DETAILED DESCRIPTION

Figure 1:
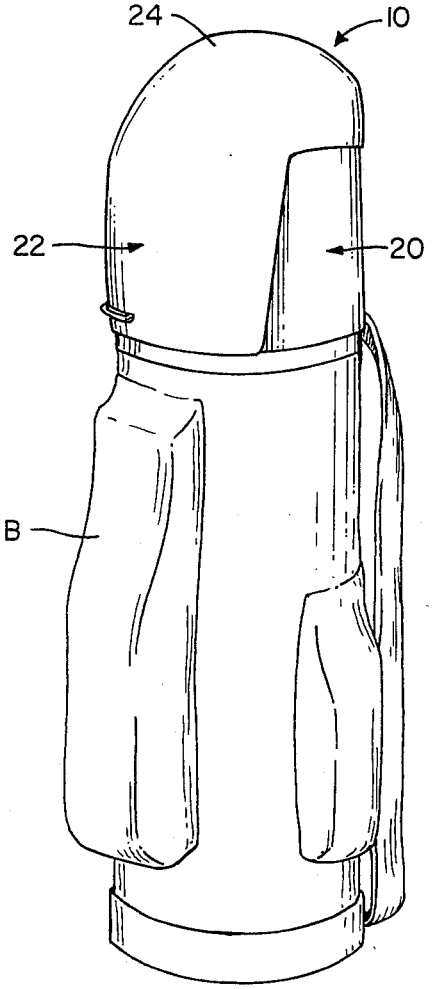
FIG. 1 shows the invention on a golf bag in the closed position, in a perspective view.

FIG. 1 shows the invention 10 as comprising major elements 20 and 22 installed on a conventional golf bag B.

The invention ha a concealed clamping ring that secures element 20 and thus element 22 to the rim of a golf bag in overlapping relation that sheds rain both from the hemi-cylindrical upstanding wall or upright, or vertical half-shield, member 20 at the rear and the helmet-shaped member 22 at the front.

The helmet-shaped member extends over the top 24 where it overlaps all around, and at the bottom as far back as the sides extend.

Both members 20 and 22 are unitary, generally rigid portions, which may be of plastic sheet over a frame or of rigid ABS plastic with the necessary hardware molded into it.

Figure 2:
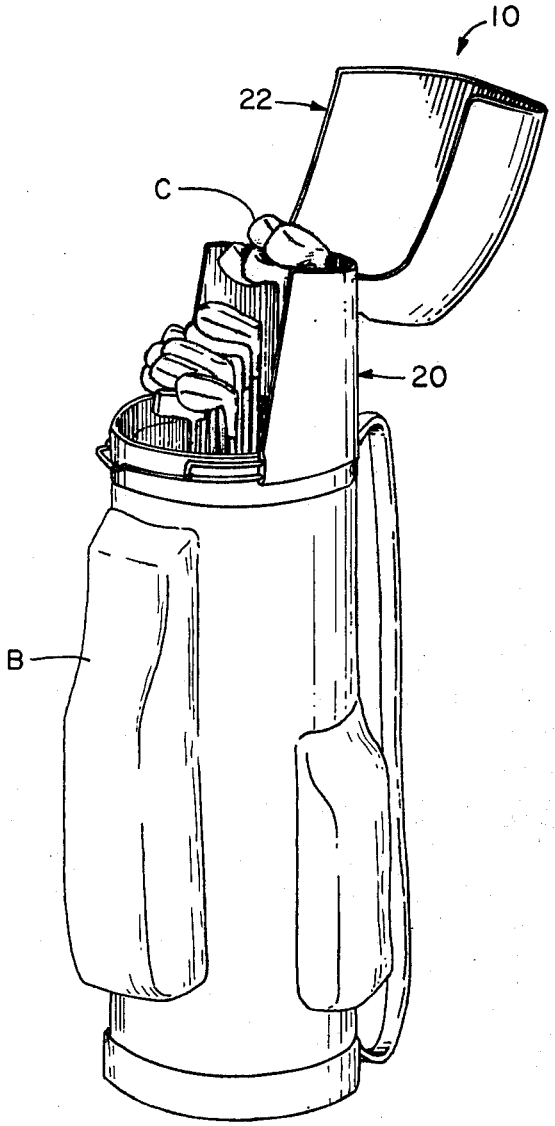
FIG. 2 shows the invention on a golf bag in the fully open position, in a perspective view.

FIG. 2 shows the helmet-shaped portion or member 22 pivoted up and over to the extreme open position where it automatically holds open. In this position it clears the vertical half-shield portion or member 20 entirely, giving full top-access and half-circle side or lateral access to golf clubs C in the bag B. It can be seen that the member 20 effectively extends a portion of the golf bag and a top opening area adjacent thereto in an upward direction for shielding clubs from blowing rain while preserving club access laterally.

Figure 3:
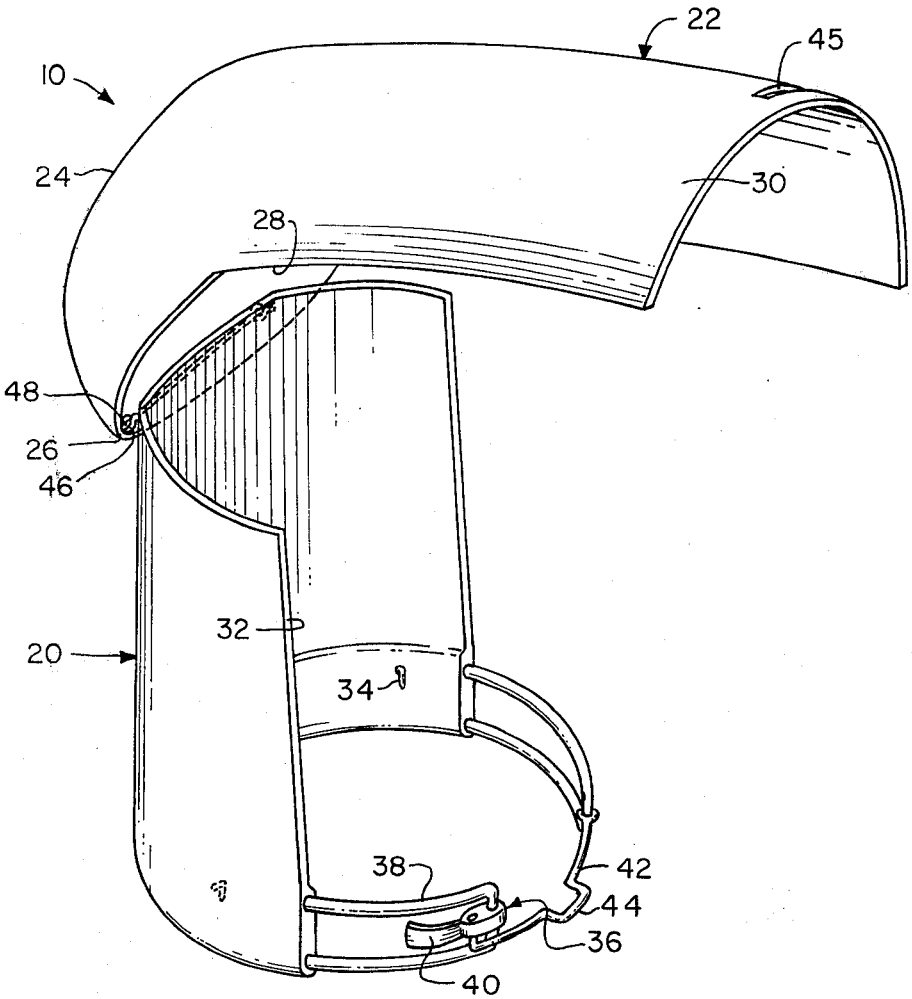
FIG. 3 shows the invention in half-open high-roof or down-pour shielding position for still providing good club access, in perspective view.

FIG. 3 shows the helmet-shaped member 22 half-open, where it forms a horizontal high concave roof, for overhanging the top of a golf bag and protecting against falling rain.

The means providing the upwardly-spaced horizontal overhang by the helmet-shaped member includes a down-turned brim on it and a high pivot so that it will rise when opened.

The helmet-shaped member has the general shape of a football helmet: top or dome 24, downward brim portion 26, cutaway sides 28, and similar but longer hemi-cylindrical skirt portion 30 depending from the dome.

The brim portion 26 is pivoted near but below the top of the vertical half shield portion 20 at the back to provide the rising feature for the entire helmet-shaped member when open, with consequent excellent protected-access to clubs, and vertically overlaps the vertical half shield top portion for better shielding against blowing rain or snow.

In this position, when a club is removed or replaced the helmet-shaped member automatically closes. Both the near-vertical sides 32 of the half-shield 20 and the cutaway sides of the portion at 28, are purposely not quite vertical but instead in side elevational view slope towards the front to provide a water shedding overhang.

Two right-angle hooks 34 spaced at 120° and pointing down engage the golf bag on which the member 20 is mounted, and an over-center mechanism 36 of conventional design detachably clamps it in place.

The clamping ring 38 may be of ¼ inch (6 mm) diameter stainless steel or aluminum or the like, in "C"-shape with the overcenter link handle 40 and pivotal rod 42 spanning the opening in the "C"-shape. It may comprise upper and lower arcuate portions joined at the spaced-apart ends by respective vertical portions. The pivotal rod 42 may have an outward offset 44 for padlocking, to cause the slot 45 to prevent unclamping, and also to padlock to a bag portion (not shown) if desired.

Figure 4:
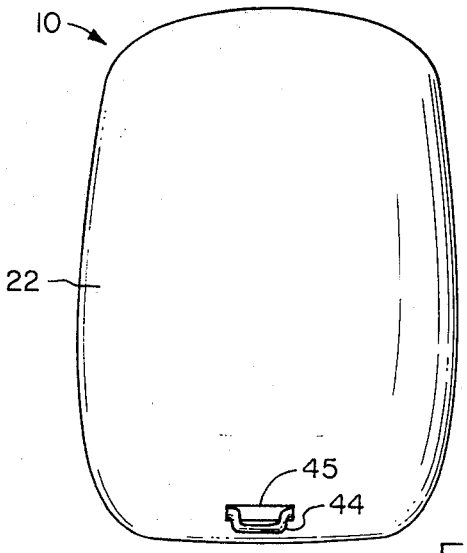
FIG. 4 is an elevational view showing locking provisions.

FIG. 4 shows the front aspect closed, with offset 44 protruding through slot 45 in member 22.

Figure 5:
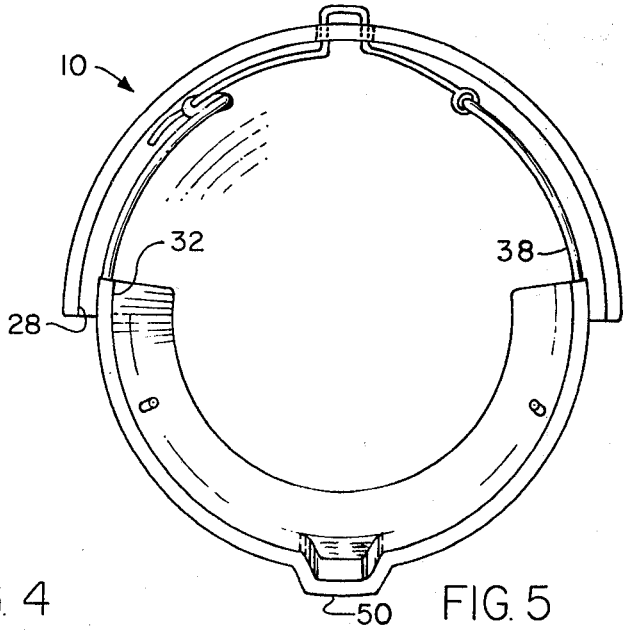
FIG. 5 is a bottom plan view.

FIG. 5 shows the interior in bottom plan view, closed. Outward curved portion 50 at the back of the clamping ring 38 is for spanning a conventional golf bag strap so that the strap need not be moved when the invention is applied or removed.

The invention presents a smooth, easy to care for exterior and interior. Desirable ventilation to prevent mildewing may be provided at the side overlaps between 28 and 32, if desired, by a free fit. In spite of the good club and bag protection provided, and the good operational clearance, it can be seen that the invention is compact and light in weight for easy handling and stowing in car trunks and the like, and won't injure other objects stowed with it. Further, it can be made of materials of any color pattern so as to match bag coloration.

This invention is not to be construed as limited to the particular forms disclosed herein, since these are to be regarded as illustrative rather than restrictive. For example, it is conceivable that some of the benefits of this invention could be provided in a more permanent mechanism on the golf bag. It is, therefore, to be understood that the invention may be practiced within the scope of the claims otherwise than as specifically described.

What is claimed and desired to be protected by U.S. Letters Patent is:

1. In a system providing a pivotal cover for the top of an elongate golf bag having a rim that is substantially rigid and defines: a top opening area for golf club access and front and a back and sides, and being of the type which may have a strap, means for extending a back portion of a said golf bag and top opening area adjacent thereto in an upward direction, said pivotal cover including: means for covering said upwardly extended back portion and top opening area, and means for pivoting said means for covering clear of said top opening area to a fully open position for golf club access the improvement comprising: means for detachably clamping the extending means around a part of a said golf bag rim, said extending means comprising a substantially rigid hemi-cylindrical upright member providing substantially a half-circle arc of golf club access, and said means for covering comprising a substantially rigid helmet-shaped member with dome and brim, cutaway sides and hemi-cylindrical skirt depending downwardly from the dome.

2. In a system as recited in claim 1, said means for detachably clamping including means for locking said system to a golf bag, comprising said means for detachably clamping being a clamping ring concealed when said means for covering is closed and having a member with an offset therein protrusive therefrom; said helmet-shaped member having a slot positioned for protrusion of said offset therethrough, and said protrusion proportioned for receiving a padlock hasp therethrough when said extending means is clamped to a golf bag.

3. In a system as recited in claim 1, a plurality of downward hooks on said extending means for detachably engaging a said golf bag rim.

* * * * *